US005452996A

United States Patent [19]

Eiermann et al.

[11] Patent Number: 5,452,996

[45] Date of Patent: Sep. 26, 1995

[54] POSITION-INDEPENDENT ROTARY PISTON INTERNAL COMBUSTION ENGINE

[75] Inventors: Dankwart Eiermann, Weissenberg-West; Josef Speiser, Wasserburg, both of Germany

[73] Assignee: Wankel GmbH, Berlin, Germany

[21] Appl. No.: 117,186

[22] PCT Filed: Jan. 13, 1993

[86] PCT No.: PCT/DE93/00020

§ 371 Date: Dec. 8, 1993

§ 102(e) Date: Dec. 8, 1993

[87] PCT Pub. No.: WO93/14300

PCT Pub. Date: Jul. 22, 1993

[30] Foreign Application Priority Data

Jan. 13, 1992 [DE] Germany ..... 42 00 613.9

[51] Int. Cl.[6] ..... F01C 21/04

[52] U.S. Cl. ..... 418/88; 418/151; 123/196 R

[58] Field of Search ..... 418/88, 3, 151; 123/196 R, 196 CP, 198 C

[56] References Cited

U.S. PATENT DOCUMENTS 3,359,952 12/1967 Jones et al. ..... 123/196 R
3,528,398 9/1970 Weissflog et al. ..... 123/196
3,877,852 4/1975 Louzecky ..... 418/88
5,085,187 2/1992 Black ..... 123/196 R

*Primary Examiner*—Richard A. Bertsch
*Assistant Examiner*—Charles G. Freay
*Attorney, Agent, or Firm*—Robert W. Becker & Associates

[57] ABSTRACT

A rotary piston internal combustion engine has a casing including a central portion and two side portions. The central portion has a trochoidal inner mantle surface. An eccentric shaft extends through the casing and has an eccentric portion with a friction bearing. Main bearings for supporting the eccentric shaft in the casing are provided. A rotary piston, triangular in cross-section and having an interior chamber and axial edges with sealing members, is mounted on the friction bearing of the eccentric portion. The sealing members remain at all times in contact with the trochoidal inner mantle surface during rotation. A lubricating system for lubricating and cooling the rotary piston includes an oil cooler, a closed oil reservoir, and an oil filter. The lubricating system has a first pump and substantially axially extending channels provided in at least one of the side portions in the vicinity of the eccentric shaft. The first pump removes oil from the rotary piston and its interior chamber through the channels into the closed oil reservoir. A second pump is provided for returning oil from the closed oil reservoir through oil cooler and oil filter to the main bearings and the friction bearing.

9 Claims, 3 Drawing Sheets

POSITION-INDEPENDENT ROTARY PISTON INTERNAL COMBUSTION ENGINE

BACKGROUND OF THE INVENTION

The invention relates to a rotary piston internal combustion engine having a casing comprised of two side portions and a center portion with a trochoidal inner mantle surface, the casing being penetrated by an eccentric shaft having an eccentric on which a triangular, oil-cooled piston rotates on a friction bearing whereby its edge sealing members are in constant contact with the inner mantle surface.

Such machines are commonly provided with an oil sump that is upwardly open and into which the lubricating and cooling oil drains and from where the oil is returned through oil filter and oil cooler into the bearings and the piston. Such an arrangement allows for a lateral tilting of the machine, which must be taken into consideration when driving an off-road vehicle or plane, only for a limited angular range because otherwise the oil supply from the oil sump is interrupted and air is sucked into the oil circuit or oil drains from the oil sump. A closed oil circuit has not been suggested for rotary piston internal combustion engines as of today and it can be realized for lifting piston machines, for example, for planes for air aerobatics, only with great constructive expenditure.

It is an object of the invention to construct a rotary piston internal combustion engine without oil sump which is position-independent, i.e., which can be tilted by 30° and more about its horizontal longitudinal and transverse axes and even into an upside-down position, which can be stored in such positions for an extended period of time, and which is compact and has a minimal end face resistance.

SUMMARY OF THE INVENTION

The rotary piston internal combustion engine according to the present invention is primarily characterized by:

a casing comprised of a central or mantle portion and two side portions, the central portion having a trochoidal inner mantle surface;

an eccentric shaft extending through the casing having an eccentric portion with a friction bearing;

main bearings for supporting the eccentric shaft in the casing;

a rotary piston, triangular in cross-section and having an interior chamber and axial edges with sealing members, mounted on the friction bearing of the eccentric portion, wherein the sealing members remain at all times in contact with the trochoidal inner mantle surface during rotation;

a lubricating system including an oil cooler, a closed oil reservoir, and an oil filter, for lubricating and cooling the rotary piston, the lubricating system further comprising:

a) a first pump;

b) channels provided in at least one of the side portions of the casing in the vicinity of the eccentric shaft, the channels extending substantially axially, wherein the first pump removes oil from the rotary piston and the interior chamber through the channels into the closed oil reservoir; and c) a second pump for returning oil from the closed oil reservoir through oil cooler and oil filter to the main bearings and the friction bearing.

Preferably, the first pump is formed by an exterior wall of the one side portion and a counterweight connected to the one side portion, wherein an end face of the counterweight facing the exterior wall has blades arranged concentrically to the eccentric shaft and wherein the exterior wall has a recess with a planar bottom and a sidewall that extends spirally in a radial outward direction, the blades extending into the recess.

Advantageously, the closed oil reservoir is arranged about the eccentric shaft.

Expediently, the second pump is an inner-axis geared pump positioned about the eccentric shaft within the oil reservoir.

Preferably, the first pump is an inner-axis geared pump positioned about the eccentric shaft. The second pump is an inner-axis geared pump also positioned about the eccentric shaft adjacent to the first pump.

In another embodiment of the present invention, the first pump is preferably formed by an exterior wall of one of the side portions and a counterweight connected to the one side portion. The end face of the counterweight facing the exterior wall has radially extending ribs, and between the exterior wall and the end face of the counterweight a gap is formed.

In a preferred embodiment of the present invention, the first pump is formed by an exterior wall of one of the side portions and a counterweight connected to the one side portion. The end face of the counterweight facing the exterior wall has a rough surface, and between the exterior wall and the end face of the counterweight a gap is formed.

The basic idea of the invention also includes the arrangement of a closed oil reservoir and/or one or two oil pumps external to the engine block proper and also the oil removal in the axial direction not only at the gear side, but on both side portions as well as the provision of more than one piston is provided.

BRIEF DESCRIPTION OF THE DRAWINGS

Embodiments of the inventive combustion engine will be explained in the following with the aid of the drawings. The drawings show in.

DESCRIPTION OF PREFERRED EMBODIMENTS

The present invention will now be described in detail with the aid of several specific embodiments utilizing FIGS. 1 to 4.

Figure 1:
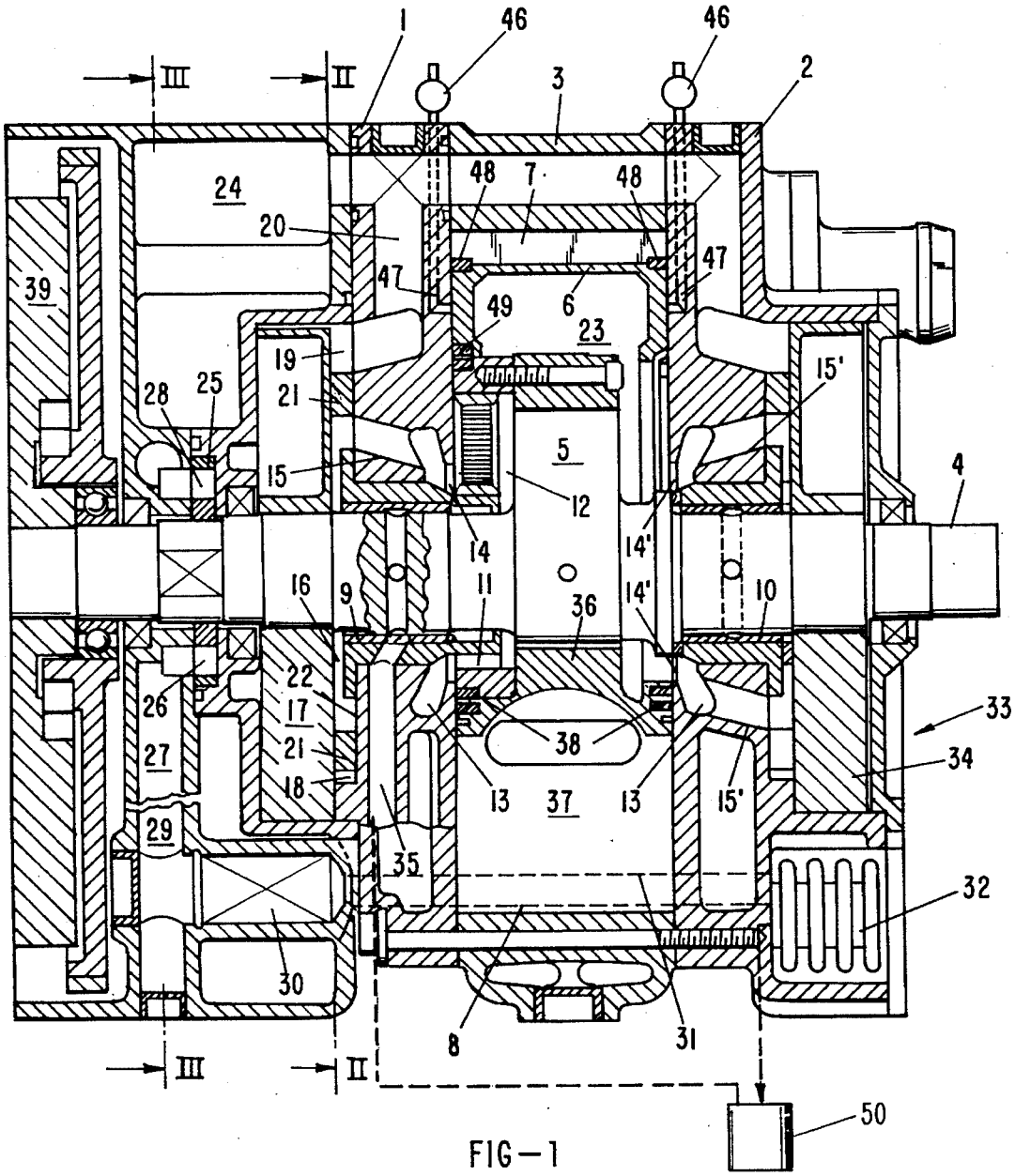
FIG. 1 an axial cross-section of an inventive rotary piston engine.
Figure 2:
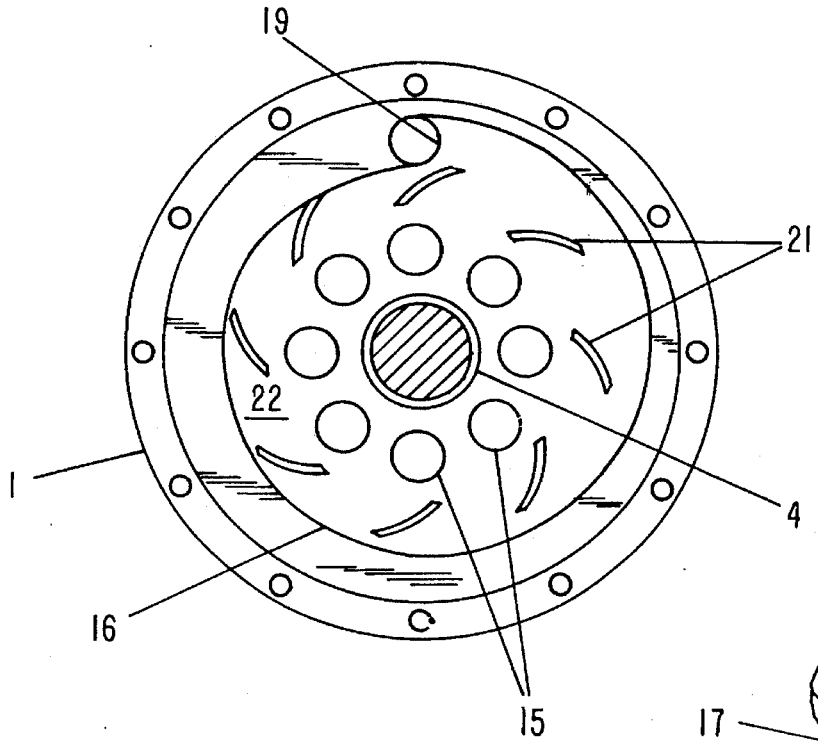
FIG. 2 a partial radial section of the same engine in the plane II—II of FIG. 1.
Figure 5:
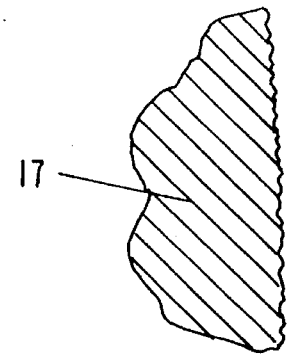
FIG. 5 shows a special embodiment of the counterweight with a rough surface.
Figure 3:
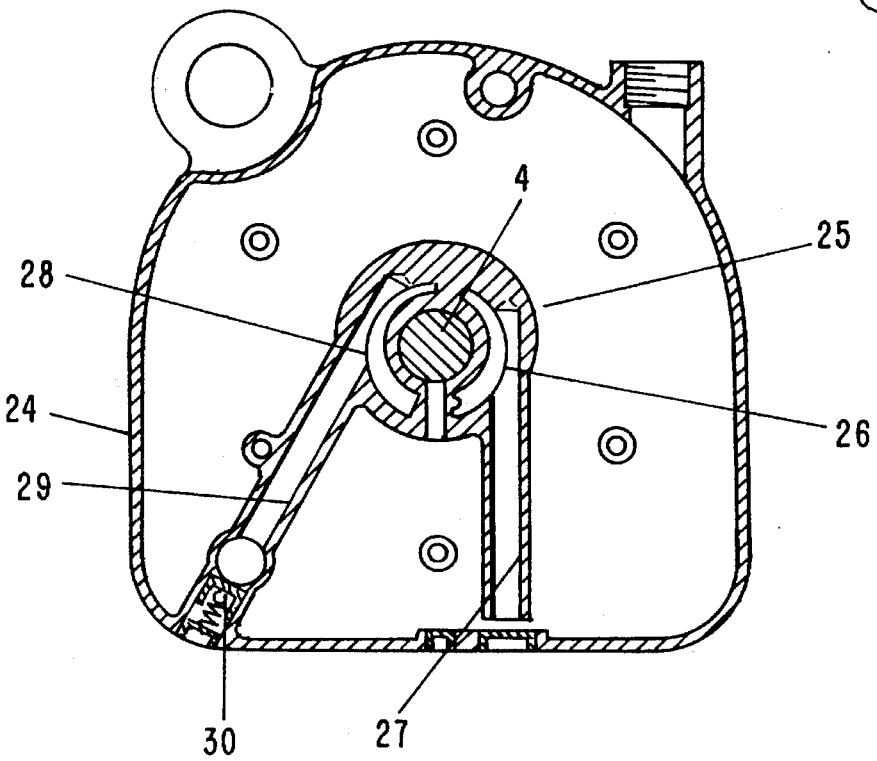
FIG. 3 a further radial section of the same engine in plane III— III of FIG. 2.

The casing of the rotary piston internal combustion engine of FIGS. 1, 2, and 3 is comprised of a left side portion 1, a right side portion 2, and a central portion 3 with a trochoidal inner mantle surface. The side portions 1 and 2 are penetrated by the eccentric shaft 4 which has an eccentric 5 on which the triangular piston 6 rotates while its edge sealing members 7 are in constant engagement with the trochoidal inner mantle surface 8. The main bearings 9 and 10, which are in the form of friction bearings, of the eccentric shaft 4 are provided in the side portions 1 and 2. The left main bearing 9 supports the pinion 11 of the synchronous gear system 12 of the piston 6.

Within the left side portion 1 an annular chamber 13 is provided into which within the area of the pinion 11 a plurality of openings 14 open from the interior of the engine. A plurality of channels 15 are arranged in the side portion 1 extending from the annular chamber 13. They open into a space 16 between the left side portion and the left counterweight 17. This space 16 is a recess within the left side portion 1. Its radial outer side wall 18, in the direction of rotation of the eccentric shaft 4, follows a spiral curve radially outwardly and forms a guide to the opening 19 of the oil channel 20. The end face of the counter weight 17 facing the left side portion 1 has blades that are arranged concentric to the eccentric shaft 4 which come into contact with the planar bottom 22 of the space 16 and the innermost portion of its axial outer sidewall 18 that begins at the opening 19 of the oil channel 20.

The oil that is guided from the eccentric shaft 4 into the piston 6 via its friction bearing and which serves for cooling the piston is conveyed upon rotation of the piston 6 by centrifugal forces to the openings 14 into the annular chamber 13 and via the channels 15 into the space 16 between the left side portion 1 and the counterweight 17 that functions as the oil conveying disk. The blades 21 and the centrifugal force acting on the oil adhering to the surface of the counterweight 17 spin the oil towards the sidewall 18 and force it into the opening 19. Within the vertical oil channel 20 positioned downstream of the opening 19 the oil then rises into the oil reservoir 24. This oil reservoir 24 is closed on all sides and is positioned as an annulus about the eccentric shaft 4, as shown in FIG. 3. An inner-axis geared pump 25 is mounted on the eccentric shaft 4 within the oil reservoir 24 for conveying the pressure oil from the oil reservoir 24. The pump has a suction chamber 26 connected to a vertical suction tube 27 that extends into the vicinity of the lower bottom of the oil reservoir 24. The pressure chamber 28 of the geared pump 25 opens into a tube 29 the free end of which is closed by a valve 30 that during pumping of the geared pump 25 is open. This valve 30 is shown in FIG. 1 in the left lower corner in section in a different, forwardly positioned plane. The pressure oil line 31 extends from this valve axially along the forward side of the internal combustion engine not visible in FIG. 1 to the lower corner of the round machine casing to an oil cooler 32 that is provided at the bottom of the drive side 33 of the internal combustion engine below the right counterweight 34. This position of the oil cooler 32 is especially advantageous when the internal combustion engine is used as an aviation engine.

Along the rearward side of the internal combustion engine at the lower corner below the round machine casing (FIG. 1), a pressure oil line extends from the oil cooler 32 to the left side portion 1, from there through this side portion 1 into the oil feed line 35 and into the eccentric shaft 4 and then into the main bearings 9 and 10, the eccentric bearing 36, and the interior chamber 23 of the piston 6. A transfer of oil into the working chambers 37 of the combustion engine is prevented by the inner oil seals 38 and, when the machine is not in operation, by the valve 30.

The arrangement of the suction tube 27 extending into the vicinity of the bottom of the oil reservoir 24, as shown in FIG. 1, allows for operation at a tilting angle of up to 30° in all directions, even when the oil level is low. When greater tilting angles are to be taken into consideration, the suction opening of the suction tube 27 must be positioned closer to the geared pump 25. An upside down positioning of the internal combustion engine requires the positioning of the suction opening directly at the level of the geared pump 25 and a respectively high oil level within the oil reservoir 24.

On the right side of the internal combustion engine an identical embodiment of the right counterweight 34 as a conveying disk for the oil exiting from the piston 6 and the eccentric bearing 36 via the openings 14' and of the annular chamber 13' and channels 15' within the right side portion 2 may be provided. The oil is then conveyed via the opening 19' and the vertical oil channel 20' in the right side portion 2 into a horizontal oil channel 39 within the center portion 3 into the oil reservoir 24.

Figure 4:
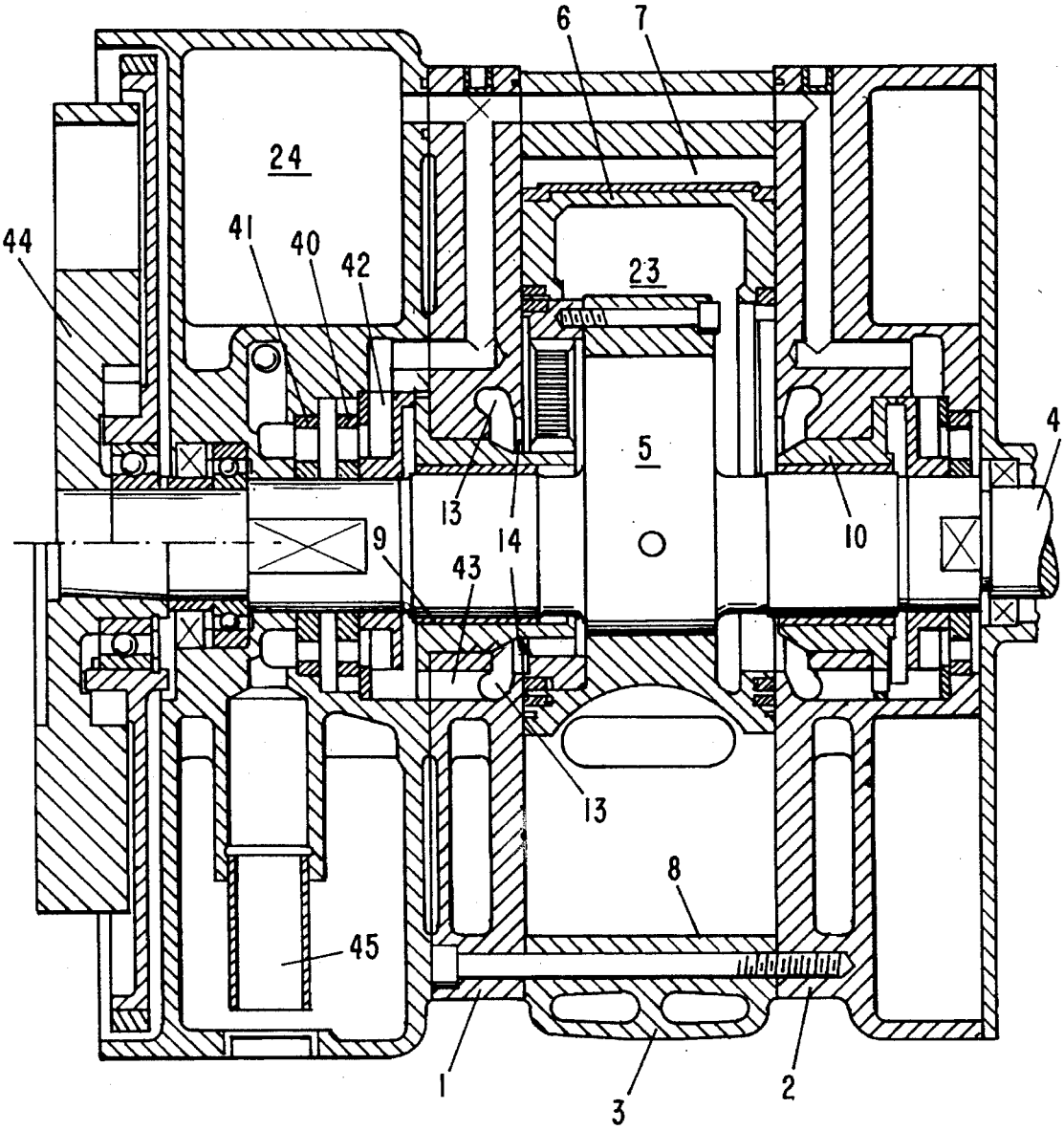
FIG. 4 an axial section of a further embodiment.

In the embodiment of FIG. 4 a first inner-axis geared pump 40 and a second inner-axis geared pump 41 are arranged on the eccentric shaft 4. Suction lines 42 and 43 extend from the annular chamber 13 and the openings 14 connecting to the interior of the machine to the first geared pump 40, i.e., extend from the gear chamber in direct vicinity of the pinion 11, as shown in the embodiment of FIG. 1. The geared pump 41 which pumps the oil in the oil reservoir 24 replaces in this embodiment the conveying disk of the counterweight 17 which consequently must be positioned outwardly to the left of the oil reservoir 24 and is embodied by the flywheel 44. The second geared pump 41 sucks via the suction tube 45 oil from the oil reservoir 24 and forces it via the oil feed line into the oil circuit which corresponds in its embodiment to the embodiment of FIG. 1.

Since within the oil container 24 a high pressure may be generated due to gases transferred from the interior, which high pressure could interrupt the oil circuit, a venting line 47 is provided in a conventional manner within the side portion 1 facing the oil reservoir 24. The venting line 47 has a venting valve 46 and opens into the gap between the gas seal 48 and the inner oil seal 49 of the piston 6.

The present invention is, of course, in no way restricted to the specific disclosure of the specification and drawings, but also encompasses any modifications within the scope of the appended claims.

We claim:

1. A rotary piston internal combustion engine comprising:

a casing comprised of a central portion and two side portions, said central portion having a trochoidal inner mantle surface;

an eccentric shaft extending through said casing having an eccentric portion with a friction bearing;

main bearings for supporting said eccentric shaft in said casing;

a rotary piston, triangular in cross-section and having an interior chamber and axial edges with sealing members, mounted on said friction bearing of said eccentric portion, with said sealing members remaining at all times in contact with said trochoidal inner mantle surface during rotation;

a lubricating system including an oil cooler, a closed oil reservoir, and an oil filter, for lubricating and cooling said rotary piston, said lubricating system further comprising:

a) a first pump;

b) channels provided in at least one of said side portions of said casing in the vicinity of said eccentric shaft, said channels extending substantially axially, wherein said first pump removes oil from said rotary piston and said interior chamber through said channels into said closed oil reservoir;

c) a second pump for returning oil from said closed oil reservoir through said oil cooler and said oil filter to said main bearings and said friction bearing; and wherein said closed oil reservoir is positioned in said casing and wherein rotating elements of said first and said second pumps are mounted on said eccentric shaft.

2. A rotary piston internal combustion engine according to claim 1, wherein said first pump is formed by an exterior wall of one of said side portions and wherein said rotating element of said first pump is a counterweight positioned in said one side portion, wherein an end face of said counterweight facing said exterior wall has blades arranged concentrically to said eccentric shaft and wherein said exterior wall has a recess with a planar bottom and a sidewall that extends spirally in a radial outward direction, with said blades extending into said recess.

3. A rotary piston internal combustion engine according to claim 1, wherein said closed oil reservoir is surrounds said eccentric shaft.

4. A rotary piston internal combustion engine according to claim 1, wherein said second pump is an inner-axis geared pump positioned about said eccentric shaft within said oil reservoir.

5. A rotary piston internal combustion engine according to claim 1, wherein said first pump is an inner-axis geared pump positioned about said eccentric shaft and wherein said second pump is an inner-axis geared pump positioned about said eccentric shaft adjacent to said first pump.

6. A rotary piston internal combustion engine according to claim 1, wherein said first pump is formed by an exterior wall of one of said side portions and wherein said rotating element of said first pump is a counterweight positioned in said one side portion, wherein an end face of said counterweight facing said exterior wall has radially extending ribs and wherein between said exterior wall and said end face of said counterweight a gap is formed.

7. A rotary piston internal combustion engine according to claim 1, wherein said first pump is formed by an exterior wall of one of said side portions and wherein said rotating element of said first pump is a counterweight positioned in said one side portion, wherein an end face of said counterweight facing said exterior wall has a rough surface and wherein between said exterior wall and said end face of said counterweight a gap is formed.

8. A rotary piston internal combustion engine comprising:

a casing comprised of a central portion and two side portions, said central portion having a trochoidal inner mantle surface;

an eccentric shaft extending through said casing having an eccentric portion with a friction bearing;

main bearings for supporting said eccentric shaft in said casing;

a rotary piston, triangular in cross-section and having an interior chamber and axial edges with sealing members, mounted on said friction bearing of said eccentric portion, with said sealing members remaining at all times in contact with said trochoidal inner mantle surface during rotation;

a lubricating system including an oil cooler, a closed oil reservoir, and an oil filter, for lubricating and cooling said rotary piston, said lubricating system further comprising:

a) a first pump;

b) channels provided in at least one of said side portions of said casing in the vicinity of said eccentric shaft, said channels extending substantially axially, wherein said first pump removes oil from said rotary piston and said interior chamber through said channels into said closed oil reservoir;

c) a second pump for returning oil from said closed oil reservoir through said oil cooler and said oil filter to said main bearings and said friction bearing; and wherein said second pump is an inner-axis geared pump mounted on said eccentric shaft within said oil reservoir.

9. A rotary piston internal combustion engine comprising:

a casing comprised of a central portion and two side portions, said central portion having a trochoidal inner mantle surface;

an eccentric shaft extending through said casing having an eccentric portion with a friction bearing;

main bearings for supporting said eccentric shaft in said casing;

a rotary piston, triangular in cross-section and having an interior chamber and axial edges with sealing members, mounted on said friction bearing of said eccentric portion, with said sealing members remaining at all times in contact with said trochoidal inner mantle surface during rotation;

a lubricating system including an oil cooler, a closed oil reservoir, and an oil filter, for lubricating and cooling said rotary piston, said lubricating system further comprising:

a) a first pump;

b) channels provided in at least one of said side portions of said casing in the vicinity of said eccentric shaft, said channels extending substantially axially, wherein said first pump removes oil from said rotary piston and said interior chamber through said channels into said closed oil reservoir;

c) a second pump for returning oil from said closed oil reservoir through said oil cooler and said oil filter to said main bearings and said friction bearing; and wherein said first pump is an inner-axis geared pump is mounted on said eccentric shaft and wherein said second pump is an inner-axis geared pump mounted on said eccentric shaft adjacent to said first pump.

* * * * *